United States Patent [19]

Moore

[11] Patent Number: 4,825,223

[45] Date of Patent: Apr. 25, 1989

[54] MICROWAVE REFLECTOR ASSEMBLY

[75] Inventor: Brian H. Moore, Edmonton, Canada

[73] Assignee: Tsiger Systems Corporation, Edmonton, Canada

[21] Appl. No.: 934,818

[22] Filed: Nov. 25, 1986

[51] Int. Cl.[4] ..... H01Q 19/12

[52] U.S. Cl. ..... 343/840; 343/914

[58] Field of Search ..... 343/840, 914, 835, 837

[56] References Cited

U.S. PATENT DOCUMENTS

| | | | |
|---|---|---|---|
| 1,906,546 | 5/1933 | Darbord | 343/840 |
| 2,695,958 | 11/1954 | Lewis | 343/914 |
| 4,513,293 | 4/1985 | Stephens | 343/914 |

FOREIGN PATENT DOCUMENTS

| | | | |
|---|---|---|---|
| 0027346 | 3/1979 | Japan | 343/840 |
| 0081706 | 5/1982 | Japan | 343/840 |

*Primary Examiner*—William L. Sikes

*Assistant Examiner*—Hoanganh Le

*Attorney, Agent, or Firm*—John A. Baker

[57] ABSTRACT

The present invention relates to a reflective assembly for use in an antenna for receiving an incident microwave signal having a wavelength λ. The reflective assembly is comprised of a sequence of microwave reflective surfaces facing in a common direction. Each reflective surface is at least a portion of a concave surface of one of a corresponding sequence of paraboloids that have a common axis and a common focal point. A unit is provided for mounting the reflective surfaces in an array such that when the incident microwave signal is received parallel to the access, each reflective surface reflects the incident microwave signal as a reflected microwave signal onto the common focal point, wherein each reflected microwave signal arrives at the common focal point in-phase with each other of the reflected microwave signals.

15 Claims, 3 Drawing Sheets

MICROWAVE REFLECTOR ASSEMBLY

BACKGROUND OF THE INVENTION

The present invention relates to microwave reflective assembly and in particular to a reflector assembly for use with a conventional receiving horn, the combination providing a microwave antenna. The description of the inventive reflector assembly will be made describing it with respect to a receiving antenna. The reflective assembly of the present invention could just as well serve as a reflective assembly in a transmitting antenna.

Antennas which conventionally receive satellite television signals have reflector assemblies in the shape of a parabolic dish. Such assemblies are very large in size and can range from 4 to 14 feet in diameter depending on the location of the receiver. Reflective assemblies can comprise solid metal parabolic surfaces or mesh screen surfaces. If the assembly is a mesh, heavy support structure is necessary to maintain the required surface accuracy. Transportation of such assemblies or kits to make such assemblies is costly. The resulting assemblies or its support structure is heavy requiring a very substantial mounting system.

SUMMARY OF THE INVENTION

The present invention contemplates a very thin, light weight reflective assembly made up of a sequence of reflective surfaces. One embodiment of the inventive reflector assembly is comprised of a reflector array located between two imaginary parallel major surfaces separated by one-half a wavelength of the signal being received a sequence of parabolically shaped reflective surfaces make up the reflector array. Another specific embodiment of the reflective assembly is comprised of a reflective array located between two curved imaginary major surfaces which are separated from one another by one-half a wavelength of the receiving frequency.

A reflective assembly of the invention is lightweight and can be folded into a size which can be easily shipped at a much reduced expense. Since the reflective assembly requires no stiffening back-structure, it is inexpensive. The lightweight construction of the inventive reflective assembly allows for a lighter mounting system than the mounting system used with conventional dish antennas.

A thin planar version of the antenna can be designed to be mounted at an incline with respect to the common axis of the sequence of paraboloids which generated its sequential reflective surfaces so that the focal point of the antenna is outside of its aperture. Losses and noise are reduced if the receiving horn of an antenna can be located outside of the antenna aperture. Such a configuration also simplifies the support structure for the receiving horn, thereby further reducing the cost and the weight of the resulting antenna.

When rays emanating from a wavefront which is perpendicular to the axis of a paraboloid strike the concave reflective surface of a paraboloid, the rays are reflected to the focus of the paraboloid. Since, by definition, the distance travelled from the wavefront to the focal point via reflective the paraboloid surface is always constant for any ray, the rays focus at the focal point in-phase. As a result, a parabolic reflector with a receiver means located at its focal point provides an antenna having gain, with the gain being proportional to the ratio of the diameter of the paraboloid divided by the wavelength of the frequency being received. The present invention realizes the fact that if this constant distance were increased by exactly one wavelength, and another paraboloid reflecting surface were provided in such a way that the focal point was the same, then rays reflecting from the surface of that second paraboloid to the focal point would be in-phase but retarded by one wavelength with respect to the rays being focused at the focal point from the first paraboloid. If the carrier frequency is much higher than the highest modulating frequency, the phase error at the modulating or information frequency will be small and virtually negligible. However, as the number of different paraboloid surfaces increases to a large number, an antenna employing a reflective assembly of the present invention does become bandwidth limited.

One purpose of the antenna of the present invention is to receive satellite television signals. The center frequency of the carrier for such satellite communications is currently 4 GHz. Twelve television signals are modulated on the carrier in each orthogonal polarization. The bandidth of an antenna utilizing a reflective assembly according to the present invention, which has sufficient gain to receive such signals, even in fringe locations, has been found to be more than adequate.

As will be described in detail below, the fact that the gain of the antenna is derived by adding the received signal together over a plurality of adjacent wavelengths has the added feature of reducing the peak noise gain of the antenna. This feature is particularly advantageous when the antenna is connected to a sensitive low noise receiving amplifier which is prone to being saturated by noise peaks.

In accordance with an aspect of the invention there is provided a reflective assembly for use in an antenna for receiving an incident microwave signal having a wavelength $\lambda$, comprising a sequence of microwave reflective surfaces facing in a common direction, each said reflective surface being at least a portion of a concave surface of one of a corresponding sequence of paraboloids that have a common axis and a common focal point, and means for mounting said reflective surfaces in an array such that when said incident microwave signal is received parallel to said axis, each reflective surface reflects said incident microwave signal as a reflected microwave signal onto said common focal point, wherein each reflected microwave signal arrives at said common focal point in-phase with each other of said reflected microwave signals.

BRIEF DESCRIPTION OF THE DRAWINGS

In drawings which illustrate embodiments of the invention.

DESCRIPTION OF THE PREFERRED EMBODIMENTS

Before the invention is discussed in detail, it should be realized that the height of the reflecting portion of the antenna of the present invention can be many hundreds of centimeters. On the other hand, the depth of the reflecting portions of the antenna can be in the order of ½ a wavelength or 3.5 centimeters at a frequency of 4 GHz. As a result the "depth" dimension, i.e. the dimension along the common axis of paraboloids in figures which are in cross section, is highly exaggerated. If such an exaggeration had not been made, the paraboloic shape of the reflective surfaces would not be realized.

Figure 1:
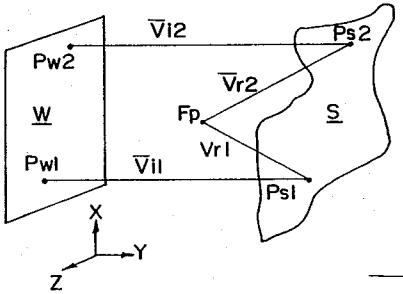
FIG. 1 is a theoretical diagram for showing the general principles of the invention.

The general case for the present invention will be explained with reference to FIGS. 1 and 2. With reference to FIG. 1, consider a plane W as an in-phase source of radio frequency energy. In order for an antenna reflector S to operate with gain, the rays of the radio frequency energy must reflect from the reflecting service S and focus in-phase at a focal point FP.

The surface S will exhibit gain if:

$$|\overline{V}_i| + |\overline{V}_r| = K + n \cdot \lambda$$

where $|\overline{V}_i|$ is the absolute value of the incident vector from plane W to surface S, $|\overline{V}_r|$ is the absolute value of the reflected vector from surface S to the point FP, K is a constant, n are the integers 0, 1, 2, 3, . . . and λ is the wavelength of the frequency received.

If two arbitrary points $P_{w1}$ and $P_{w2}$ are considered on the plane W, vectors joining points $P_{w1}$ and $P_{w2}$ to points $P_{s1}$ and $P_{s2}$ on the reflecting surface can be denoted as $\overline{V}_{i1}$ and $\overline{V}_{i2}$, respectively, and vectors $\overline{V}_{r1}$ and $\overline{V}_{r2}$ denote vectors joining points $P_{s1}$ and $P_{s2}$ to point PF, respectively.

Gain will occur when:

$$|\overline{V}_{i1}| + |\overline{V}_{r1}| = |\overline{V}_{i2}| + |\overline{V}_{r2}| = K + n \cdot \lambda \quad (1)$$

or $$|P_{w1}(xyz) - P_{s1}(xyz)| + |P_{s1}(xyz) - FP(xyz)| = \quad (2)$$

$$|P_{w2}(xyz) - P_{S2}(xyz)| + |P_{s2}(xyz) - FP(xyz)| = k + n \cdot \lambda$$

In order to solve this equation, it is convenient to choose a specific case where symmetry aids simplification.

If a parabola is choosen for the cross-sectional shape of the surface which has an axis which is perpendicular to the plane W then K+n·λ is merely a constant. For the sake of simplicity, the plane W has been moved so that the focus of the parabola shown in FIG. 2 lies in the plane. Referring then to FIG. 2, for any ray R, $$S + V = 2F = \text{constant} \quad (3)$$

but $S = F - X$ so $(F - X) + V = 2F$ from pythagoras $V^2 = y^2 + (F - X)^2$ $$\text{so } 2F = (F - X) + \sqrt{y^2 + (F - X)^2} \quad (4)$$

$$x + F = \sqrt{y^2 + (F - X)^2}$$

$$(X + F)^2 = y^2 + (F - X)^2$$

-continued $$y^2 = 4FX$$

Equation (4) is the standard equation for a parabola.

In accordance with equation (4) and the constraint of a particular embodiment of the present invention that the thickness of the reflector of the antenna be λ/2 deep, the constant in equation (3) becomes F+nλ/2, where n=0, 1, 2, 3, . . . , and λ is the wavelength of the received frequency. If FIG. 2 is considered, equation (4) becomes $$y^2 = 4\left(F + \frac{n\lambda}{2}\right), \text{ where } n = 0, 1, 2, 3, \ldots \quad (5)$$

Equation (5) describes a family of parabolas, with a common focal point. Each adjacent parabola in the family has a focal length which is larger or smaller by λ/2 of the received frequency.

The equation has been solved for a parabola. In fact, reflecting surfaces are paraboloids, which are the solids of revolution of the family of parabolas about their common axis.

Figure 2A:
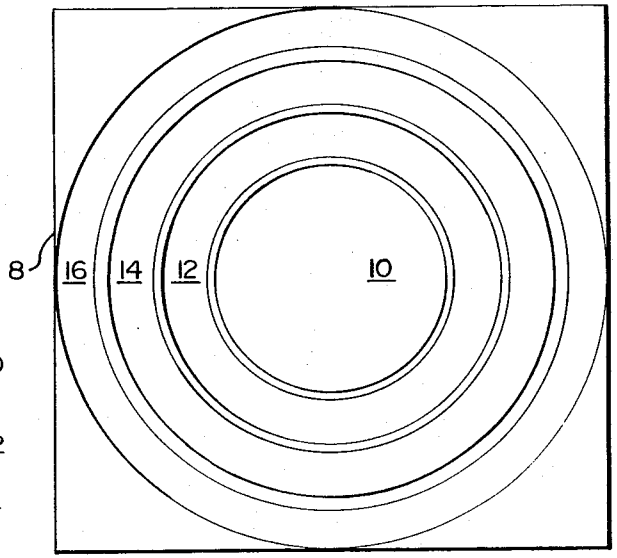
FIGS. 2 and 2A are schematic side and front views, respectively, of one embodiment of the present invention.
Figure 2:
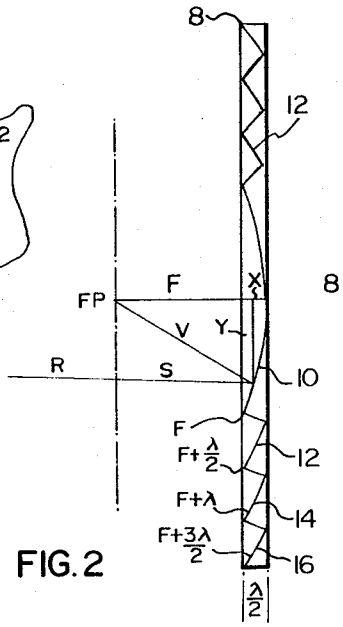

FIGS. 2 and 2A show this family of parabolas constrained to a region 8 which is λ/2 deep. The first reflecting surface is in the form of a paraboloid 10 shown in FIGS. 2 and 2A and has a focus for n=0 and forms a relatively small parabolic dish in the center of region 8 with a depth of λ/2. The next paraboloid having a focus of F+λ/2, for n=1, forms an annular parabolic reflecting surface 12 within the region 8.

FIGS. 2 and 2A illustrate other annular parabolic reflecting surfaces 14 and 16 generated from paraboloids having focal lengths equal to F+λ and F+3λ/2, for n=2 and n=3, respectively.

The gain of an antenna is proportional to its surface area. As a result, the number of annular parabolic rings will be determined by the gain desired.

In accordance with the definition of a paraboloid, all rays drawn from a plane perpendicular to its axis to the surface of the paraboloid and to its focus are equidistant. Therefore, all rays reflected off surface 10 in FIGS. 2 and 2A having a wavelength λ will reach the focal point FP in-phase. Similarly, all rays reflected from the parabolic annular reflecting surface 12 will be in-phase. Since the surface 12 is selected from a paraboloid having a focus F+λ/2, the rays at the focus FP reflected from surface 12 will be in-phase but lagging by one wavelength with respect to the rays reflected by the surface 10. The rays reflected from surface 14 will be in-phase but 2 wavelengths lagging with respect to the rays at the point FP reflected from surface 10. Finally, the rays reflected from surface 16, for the same reasons, will be in-phase but will lag the rays from surface 10 by 3λ at the focal point FP.

Since all of the rays emanating from the plane perpendicular to the axis of the antenna meet at the focus in-phase, the rays reinforce and the antenna has gain. The gain is dependent on the wavelength of the frequency being received and the antenna discriminates that frequency. The focal lengths of the paraboloids generating the annular parabolic reflectors will not equal K+n/2 for a frequency other than the design frequency and therefore these rays at this other frequency will destructively interfer. As a result, an antenna utilizing the reflective assembly of the present invention has a gain peak at the design frequency. This is advantageous when trying to receive signals from a point source which is physically near another point source of a different frequency. However, an antenna having a reflective assembly in accordance with the present invention is bandwidth limited when the number of annular reflecting surfaces is large. This will be discussed in more detail with respect to FIGS. 3 and 4.

In FIGS. 2 and 2A, a conventional horn type signal detector is used to receive the signals reflected by the reflective assembly. The horn type detector is located at the focal point FP and is supported there by arms which come from the 4 corners of the reflector assembly. For the sake of simplicity, these arms and the detecting horn have been omitted but they form part of the complete antenna system. Another type of detecting system uses a feed horn but it is supported at the focal point by a pipe arrangement which is located at the center of the reflective assembly and extends outwardly. Either of these embodiments require that structure be located in the aperture of the reflecting portion of the antenna. This structure causes a decrease in the theoretical gain and also introduces other perturbations in the antenna which tend to increase the noise received by the antenna. Since the region 8 of the antenna according to the present invention can be located in any part of the family of paraboloids, it is possible to devise an antenna which has focal point outside the aperture of the reflecting portion of the antenna.

Figure 3:
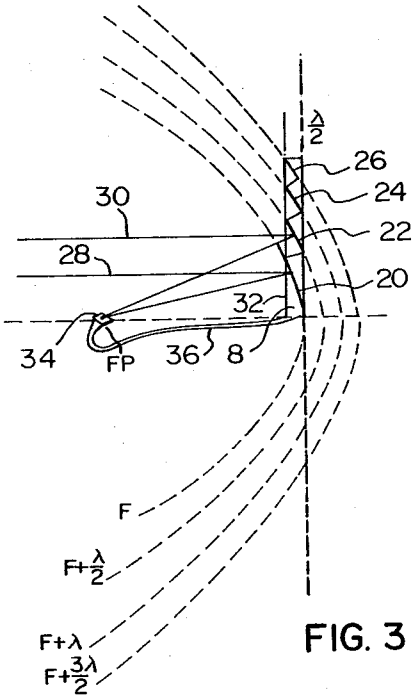

FIG. 3 shows the cross section of an antenna having a region 8 which has a focal point FP just on the bottom edge of the aperture. The region is bounded by imaginary parallel planes which are separated by a distance of $\lambda/2$ at the receive frequency and consists of a first reflecting surface 20 which, if viewed in perspective would comprise the top half of a paraboloid. The half paraboloid has a depth of $\lambda/2$. A reflecting surface 22 is in the form of a top half of a parabolic annulus. Surface 22 also has a depth of $\lambda/2$ and is derived from a paraboloid having a focal length $F+\lambda/2$ and also having a focus which is coincident on the focal point of the paraboloid which produces surface 20. Similar reflecting parabolic semi annular surfaces 24 and 26 are shown in FIG. 3 and are derived from paraboloids having the same focal point, a common axis and a focal length equal to $F+\lambda$ and $F+3\lambda/2$, respectively.

All parallel rays 28 striking surface 20 are focused at point FP in-phase. All parallel rays 30 striking surface 22 are focused at point FP in-phase. However, rays 30 reach the focal point FP one wavelength later. As a result, rays 30 positively reinforce rays 28 and the antenna exhibits gain. Parallel rays striking surface 24 add in-phase at point FP and lag rays 28 by 2 wavelengths. Parallel rays striking surface 26 add in-phase at point FP and lag rays 28 by 3 wavelengths. The gain of the antenna shown in FIG. 3 is determined by the surface area of the front side 32 of the reflecting array and in order to have a gain similar to the antenna shown in FIGS. 2 and 2A would require approximately twice as many semi annular parabolic reflecting surfaces. This would mean that the gain of the antenna was derived from receiving the signal over twice as many wavelength periods. The embodiment shown in FIG. 3 would therefore be more bandwidth limited than the embodiment shown in FIGS. 2 and 2A.

The embodiment of FIG. 3 however, has the advantage that the receiving horn 34 is located virtually out of the aperture of the antenna. In particular, the support structure, which locates the horn, is completely out of the aperture. Such a support structure is shown in FIG. 3 as a shaped tube 36 which can be connected to the bottom of the reflective assembly.

Figure 4A:
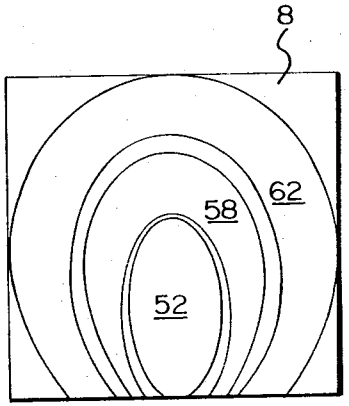
FIG. 4A is a schematic front view of the third embodiment first shown in FIG. 4.
Figure 4:
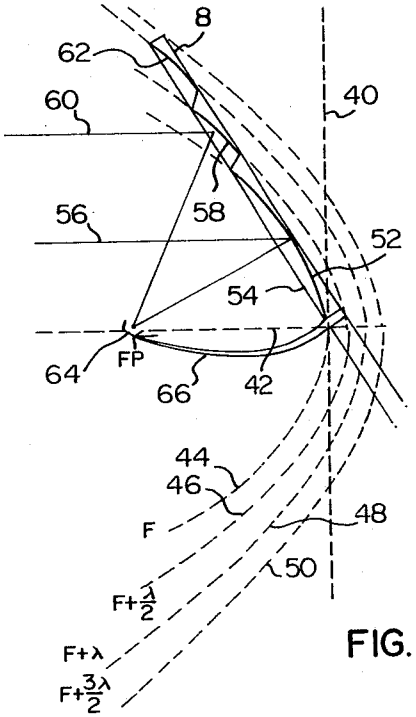
FIGS. 3, 4 and 5 are schematic side views of second, third and fourth embodiments of the present invention.

The antenna embodiment shown in FIGS. 4 and 4A moves the focal point completely out of the aperture of the antenna since the region 8 is inclined with respect to the perpendicular of the common axis of the family of paraboloids. The same gain can be achieved as an antenna shown in FIG. 3 having the same frontal surface area using a fewer number of reflecting surfaces. As a result, the advantageous of an out of aperture focal point are derived without as great a bandwith limitation.

In FIG. 4, the region 8 is inclined at an acute angle with respect to the perpendicular 40 of the axis 42 which is common to all of the paraboloids, 44, 46, 48 and 50. The region 8 is bounded by imaginary parallel planes which are separated by a distance of $\lambda/2$ at the received frequency. Reflective surface 52 is a segment of a paraboloid 44 which is $\lambda/2$ deep cut by an imaginary plane 54. The surface 52 is shown in FIG. 4A which is a front view of the region 8. The region 52 reflects parallel rays 56 to the focal point FP which is located completely outside of the antenna aperture. A second reflecting region 58 is derived from paraboloid 46 and forms a semi ellipsoid like surface partly surrounding reflective surface 52. Parallel rays 60 are focused on focal point FP by reflecting surface 58 in-phase with rays 56 but delayed by one wavelength. Similarly, a third region 62 reflects rays to the focal point FP in-phase but delayed by 2 wavelengths with respect to the rays 56. Surface 62 is formed from a segment of paraboloid 48 and in its front view is semi elliptical like and partly surrounds reflecting surface 58. A receiving horn 64 can be located at focal point FP and can be supported by a tubular structure 66. Both horns 64 and structure 66 are outside of the aperture of the antenna.

Figure 5:
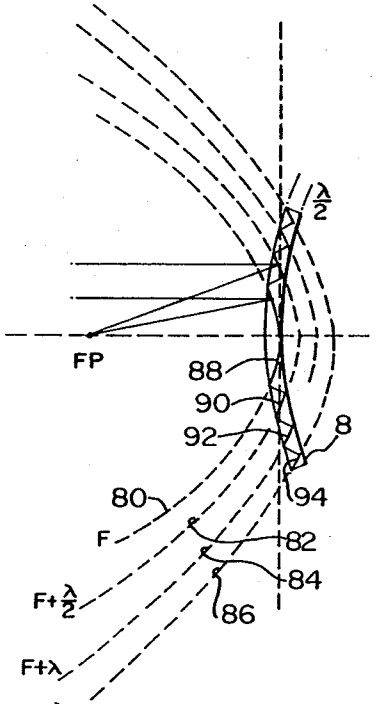

The region 8 does not necessarily have to be bounded of two parallel imaginary planes separated by one half a wavelength of the received frequency although that configuration is contemplated as being the most often used. The region can be bounded by imaginary major surfaces that are merely equidistant apart and preferably separated by $\lambda/2$. FIG. 5 shows an antenna reflective surface region 8 which is semi circular in cross section but which is $\lambda/2$ deep and which lies within a family of paraboloids all having the same focal point FP, a common axis and having focal lengths $F+n\lambda/2$ where $n=0$, 1, 2, and 3. FIG. 5 shows a family of 4 paraboloids 80, 82, 84 and 86. Reflecting surface 88 is derived from a region of paraboloid 80 and has a focal length F. Reflecting surface 90 is a parabolic annular segment derived from paraboloid 82. Similarly, surfaces 92, 94 are derived from paraboloids 84 and 86, respectively. Parallel rays 96 and 98 have the same relationship as rays 56 and 60 described with respect to FIG. 4. A receiving horn and support assembly (not shown) locate a receiver at the focal point FP in a manner which is similar to the embodiment described with respect to FIG. 2.

A significant feature with respect to this embodiment is that the reflective region 8 is curved, that its imaginary major surfaces are equidistant and that they are separated by $\lambda/2$. Because region 8 is curved, it could be configured to fit on the side of, for example, an aircraft fuselage. For that matter, it could form part of the fuselage itself. The receiving horn could be located near or on a wing edge. In another embodiment, not shown, the reflecting surface could be curved as in FIG. 5 and also inclined or skewed to move the focal point outside the aperture of the antenna. With the embodiment shown in FIG. 5, it is contemplated that a high gain microwave antenna could be constructed which would be carried on a aircraft but unlike current "AWACS" type antennas, would blend into the configuration of the aircraft itself thereby providing a much more efficient observation platform.

Figures 6A, 6B, 6C:
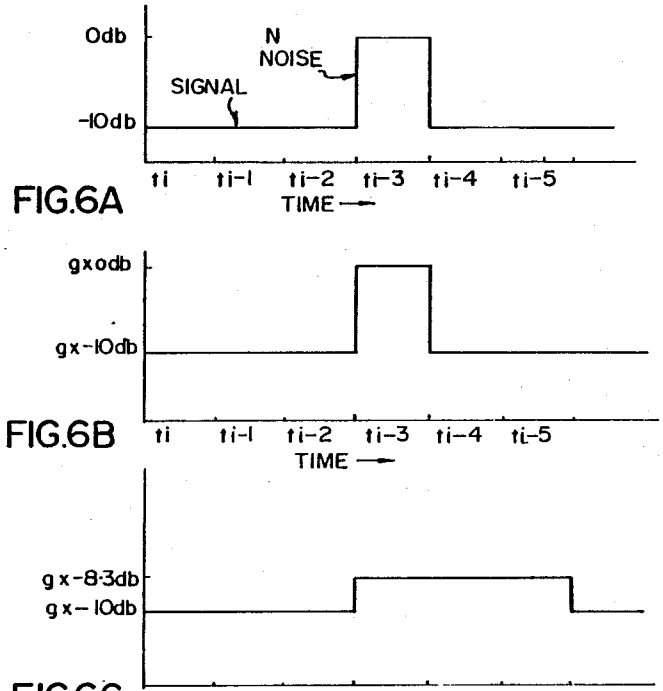
FIGS. 6A, 6B and 6C are diagrams explaining noise reduction in an antenna of the present invention.

The antennas described are primarily but by no means confined to use as satellite television receiving antennas. Such antennas are connected to low noise amplifiers. Amplifiers of this type can be driven into saturation or otherwise placed in a limiting mode by short duration high energy noise bursts. Such noise bursts are merely amplified by the gain of a conventional receiving microwave dish. The present invention on the other hand, controls short duration bursts of noise so that the saturation of the amplifiers to which they are connected is dramatically reduced. FIGS. 6A, 6B and 6C illustrate this feature.

FIG. 6A illustrates a received signal forming a generally horizontal line at a −10 db level. Suppose an intense noise pulse was somehow superimposed on this signal in time interval $t_{(i-3)}$ to a level of 0 db. If this signal were received by a conventional parabolic dish antenna having a gain of g, the resulting output signal with respect to time would look like that shown in FIG. 6B. There would be a mere linear increase by factor g for both the signal and the burst of noise. The noise level in time period $t_{(i-3)}$ would be g.0 db which would, under most conditions, be sufficient to saturate the amplifier to which the antenna was connected.

In standard television satellite communications, the modulated information is slowly time varying with respect to the center frequency of the carrier wave which is currently 4 GHz. FIG. 6C shows how an antenna of the present invention would handle the signal-noise condition shown in FIG. 6A. In the graph shown in FIG. 6C, the antenna has 7 elements, i.e. a central parabolic dish which is λ/2 deep surrounded by 6 annular parabolic reflecting surfaces. If we consider 6 time intervals $t_i, t_{(i-1)}, \ldots, t_{(i-5)}$ each equal to a period of the carrier signal, the gain g is derived from the contribution from the gains from each of the 7 elements of the antenna. However, each element of the antenna is contributing gain at a different period in the group of periods from $t_i$ to $t_{(i-5)}$.

The gain is therefore $$g\cdot((i, t_{i2}+\ldots i,)/7\cdot(i_2+i_3+\ldots i_8)/7\cdot\ldots \text{ for } t_i, t_{(i-1)} \ldots t_{(t-n)}$$

where $i_1$ is equal to the signal incident on element 1 of the 7 elements of the reflecting portion of the antenna.

It should be noted that for a signal with the noise $i_4=N$ the received signal will be $g\times((6\times i_n+1N/7))$ and as the signal is equal to the noise for $i_4$, the received signal will be g(6/7 signal+1/7 noise). A reduction of the noise content of 8.4 db compared to a 0 db noise signal will be realized which is a considerable improvement. The effect will be an increasing of the noise floor from −10 db to −8.3 db, as indicated in FIG. 6C for time intervals including time interval $t_{(i-3)}$ and time intervals which are, for a short period of time later. Such a slight increase in the noise floor output from the antenna would probably not be noticed by amplifiers connected thereto.

Figure 7:
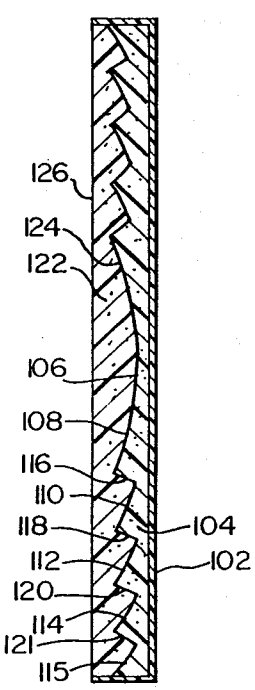
FIG. 7 is a sectional side view of a particular embodiment of antenna shown first in FIGS. 2 and 2A

The cross section of the reflecting array of one particular embodiment of the invention is shown in FIG. 7. The construction consists of a square tub 102 made of a plastic material. A first Styrofoam* (extended polystyrene) sheet 104, 167.6×167.6×5 cm is secured inside tube 102. Surface 106 is machined into sheet 104. The surface consists of a paraboloid reflecting surface 108 and 4 annular parabolic reflective surfaces 110, 112, 114 and 115. Joining edges 116, 118, 120 and 121 complete surface 106. The entire surface 106 can be metalized to act as a microwave reflector. Edge surfaces 116, 118, 120 and 121 do not interfer because they are designed to be edge on to a line drawn from the edge in question through the focal point of the antenna. Surfaces 108, 110, 112, 114 and 115 are segments of paraboloids all having a common focal point, a common axis and focal length F, F+λ/2, F+λ, F+3λ/2 and F+2λ. The depth of each surface, in the direction of the focus is 3.75 cm which is one half a wavelength at a frequency of 4 GHz. A second sheet of Styrofoam* 122 image surface 124 to surface 106 and is inserted into the plastic tub 102. A thin weatherproof plastic film 126 is placed over the opening of the tub 102. Styrofoam* sheet 122 and plastic film 126 are transparent to the 4 GHz microwave frequency. A receiving horn (not shown) of conventional design is located at the common focal point of the surfaces 108, 110, 112, 114 and 115 using a conventional support structure (not shown).

*Trade Mark

It should be noted that the thickness dimension of FIG. 7 is exaggerated with respect to the height dimension so that the parabolic surfaces can be readily observed.

It should also be noted that the second Styrofoam* sheet 122 and the film 126 are not essential and that if a second Styrofoam* sheet is used, it need not have a mirror image surface machined therein.

An antenna having the reflective surface described above was measured to have a gain of 36 db at a frequency of 4 GHz.

Other practical manifestations of the antenna are contemplated and fall within the scope of the present invention.

I claim:

1. A reflective assembly for use in an antenna for receiving an incident microwave signal having a wavelength λ, comprising a sequence of microwave reflective surfaces facing in a common direction, each said reflective surface being at least a portion of a concave surface of one of a corresponding sequence of paraboloids that have a common axis and a common focal point, and means for mounting said reflective surfaces in an array such that when said incident microwave signal is received parallel to said axis, each reflective surface reflects said incident microwave signal as a reflected microwave signal onto said common focal point, wherein each reflected microwave signal arrives at said common focal point in-phase with each other of said reflected microwave signals; wherein the focal length of each paraboloid differs by mλ/2 from the focal length of a paraboloid directly adjacent in the sequence of paraboloids, where m is a non-zero integer; and wherein said means for mounting said sequence of microwave reflective surfaces forms a region which is bounded by first and second major surfaces which are spaced an equidistance apart and edge surfaces and wherein said first and second major surfaces cut the concave surface of each paraboloid in said sequence of paraboloids such that each reflective surface of said sequence of reflective surfaces totally lies within said region.

2. The assembly of claim 1 wherein the focal length of all paraboloids in the sequence of paraboloids differ by $\lambda/2$ from the focal length of each directly adjacent paraboloid in the sequence of paraboloids.

3. The assembly of claim 2 wherein said first and second major surfaces are separated by a distance of $\lambda/2$.

4. The assembly of claim 3 wherein said first and second major surfaces are parallel to one another and are perpendicular to said common axis.

5. The assembly of claim 4 wherein said first and second major surfaces are square and symmetrically oriented about said common axis.

6. The assembly of claim 4 wherein said first and second major surfaces are square and one side edge centrally located on said common axis.

7. The assembly of claim 4 wherein said first and second major surfaces are square and one side edge centrally located above said common axis.

8. The assembly of claim 3 wherein said first and second major surfaces are parallel to one another and are acutely inclined to said common axis towards said common focal point.

9. The assembly of claim 8 wherein said first and second major surfaces are square.

10. The assembly of claim 9 wherein one edge surface is centrally located above said common axis.

11. The assembly of claim 3 wherein said first and second major surfaces are curved and are symmetrically oriented about the common axis.

12. The assembly of claim 2 wherein said means for mounting the sequence of microwave reflective surfaces includes a first square expanded polystyrene sheet having a continuous front major surface, a back major surface and edge surfaces, the front major surface including a plurality of areas, with each area occupied by one reflective surface of said sequence of microwave reflective surfaces;

microwave deflective means located on said major front surface for reflecting said reflected microwave signal to said common focal point; and tub means tightly surrounding the back and edge surfaces of said first expanded polystyrene sheet and having an open front face oriented in the common direction to provide rigidity to said first expanded polystyrene sheet.

13. The assembly of claim 12 wherein said means for mounting the sequence of microwave reflective surfaces further includes a second square expanded polystyrene sheet having major front and back surfaces and edge surfaces, said edge surfaces of the first and second expanded polystyrene sheets being congruent, said second expanded polystyrene sheet being located within said tub means with the back surface being adjacent the front surface of said first expanded polystyrene sheet; and a weatherproof film connected to said tub means across said open front face to seal the tub means, said second expanded polystyrene sheet and said weatherproof film being microwave transparent.

14. The assembly of claim 13 wherein the back surface of the second expanded polystyrene sheet is the mirror image of the front surface of the first expanded polystyrene sheet.

15. An antenna including the reflective assembly according to claim 1, said antenna further comprises a receiving means located at the common focal point.

* * * * *